US008146667B2

(12) United States Patent
Moszkowski et al.

(10) Patent No.: US 8,146,667 B2
(45) Date of Patent: Apr. 3, 2012

(54) DUAL GRADIENT PIPELINE EVACUATION METHOD

(76) Inventors: Marc Moszkowski, Houston, TX (US); Benton Frederick Baugh, Houston, TX (US)

( * ) Notice: Subject to any disclaimer, the term of this patent is extended or adjusted under 35 U.S.C. 154(b) by 0 days.

(21) Appl. No.: 12/804,258

(22) Filed: Jul. 19, 2010

(65) Prior Publication Data

US 2012/0012328 A1 Jan. 19, 2012

(51) Int. Cl.
*E21B 43/01* (2006.01)

(52) U.S. Cl. ..... 166/344; 166/267; 166/400; 166/177.3

(58) Field of Classification Search ..... 166/344, 166/351, 352, 357, 366, 368, 267, 400, 401, 166/339, 170, 177.3
See application file for complete search history.

(56) References Cited

U.S. PATENT DOCUMENTS 2,953,158 A * 9/1960 Shea et al. ..... 137/268
3,266,076 A * 8/1966 Surber ..... 15/104.062
3,384,169 A * 5/1968 Leonard ..... 166/357
3,411,483 A * 11/1968 Canoy ..... 606/116
3,495,380 A * 2/1970 Goldman et al. ..... 95/153
3,565,689 A * 2/1971 Lowe et al. ..... 134/8
3,590,919 A * 7/1971 Talley, Jr. ..... 166/357
3,788,084 A * 1/1974 Matthews, Jr. ..... 405/173
3,961,493 A * 6/1976 Nolan et al. ..... 405/158
4,216,026 A * 8/1980 Scott ..... 134/4
4,252,465 A * 2/1981 Broussard et al. ..... 405/158
4,416,703 A * 11/1983 Scott ..... 134/8
4,543,131 A * 9/1985 Purinton, Jr. ..... 134/8
4,705,114 A * 11/1987 Schroeder et al. ..... 166/357
4,745,937 A * 5/1988 Zagustin et al. ..... 137/13
4,753,261 A * 6/1988 Zagustin et al. ..... 137/13
5,117,915 A * 6/1992 Mueller et al. ..... 166/381
5,181,571 A * 1/1993 Mueller et al. ..... 166/381
5,215,781 A * 6/1993 Lowther ..... 427/11
5,232,475 A * 8/1993 Jepson ..... 95/260
5,639,313 A * 6/1997 Khalil ..... 134/18
5,795,402 A * 8/1998 Hargett, Sr. et al. ..... 134/8
5,879,561 A * 3/1999 Klomp et al. ..... 210/698
5,891,262 A * 4/1999 Khalil et al. ..... 134/22.11
6,109,829 A * 8/2000 Cruickshank ..... 405/169
6,129,150 A * 10/2000 Lima ..... 166/357
6,267,182 B1 * 7/2001 Lima ..... 166/335
6,277,286 B1 * 8/2001 S.o slashed.ntvedt et al. ..... 166/250
6,536,540 B2 * 3/2003 de Boer ..... 175/70
6,539,778 B2 * 4/2003 Tucker et al. ..... 73/49.5
6,554,068 B1 * 4/2003 Chatterji et al. ..... 166/285
6,672,391 B2 * 1/2004 Anderson et al. ..... 166/357
6,680,284 B1 * 1/2004 Heidlas et al. ..... 504/367
6,843,331 B2 * 1/2005 de Boer ..... 175/70
7,008,466 B2 * 3/2006 Collins ..... 95/153
7,093,661 B2 * 8/2006 Olsen ..... 166/357
7,264,653 B2 * 9/2007 Panchalingam et al. ..... 95/153
7,281,880 B2 * 10/2007 Tucker et al. ..... 405/154.1
7,389,818 B2 * 6/2008 Hoiland ..... 166/367
7,490,671 B2 * 2/2009 Gramme et al. ..... 166/357
7,516,794 B2 * 4/2009 Gramme et al. ..... 166/357
7,708,839 B2 * 5/2010 Yemington ..... 134/22.11
7,721,807 B2 * 5/2010 Stoisits et al. ..... 166/366
7,815,744 B2 * 10/2010 Abney et al. ..... 134/22.18
RE42,358 E * 5/2011 Tucker et al. ..... 73/49.5

(Continued)

*Primary Examiner* — Thomas Beach
*Assistant Examiner* — Matthew Buck

(57) ABSTRACT

The method of removing a first liquid from a subsea pipeline which has a central portion lower than each of the ends of the subsea pipeline by pumping a second lower density fluid into the pipeline and the either removing the second lower density fluid by either displacing it with gas or evaporating the second lower density fluid to a gas.

6 Claims, 4 Drawing Sheets

U.S. PATENT DOCUMENTS

2005/0006086 A1* 1/2005 Gramme ..... 166/105.5
2006/0115332 A1* 6/2006 Abney et al. ..... 405/169
2007/0102369 A1* 5/2007 Gramme et al. ..... 210/748
2008/0053659 A1* 3/2008 Kinnari et al. ..... 166/367
2008/0245528 A1* 10/2008 Stokka et al. ..... 166/357
2008/0296062 A1* 12/2008 Horton et al. ..... 175/5
2009/0223672 A1* 9/2009 Naik ..... 166/344
2010/0236633 A1* 9/2010 Esparza et al. ..... 137/13

* cited by examiner

DUAL GRADIENT PIPELINE EVACUATION METHOD

TECHNICAL FIELD

This invention relates to the general subject of removing unwanted water from the lower areas of a deepwater subsea pipeline using alternate liquids of lower density.

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

The field of this invention is that of removing unwanted water from deepwater pipelines. In some cases methane and other desirable gases will be produced from subsea wells and brought to the surface for initial processing. A prime function of this pre-processing is to remove the water from the gas.

After processing, the gasses will be returned to and along a seafloor pipeline for delivery to a remote location, also at sea level. As the high volume of gasses are passed into the pipeline, some portion of liquids will also reach the pipeline. These liquids, primarily water, will accumulate in the lowest points of the pipelines.

There are pipelines which have each end above sea level, and go through seafloor valleys as deep at 11,000 ft. deep. If a small amount of water accumulates in the pipeline, flowing gasses will simply percolate thru the water. The gas will push the water down on the near side and up on the far side until gas reaches the lowest point. At this time gas passes under the lowest point inside the pipeline and percolates up the far side. If there is enough water in the pipeline to raise the elevation of the water on the downstream side up 100 feet, it will take about 46.5 p.s.i. in gas pressure to do this (salt water is about 0.465 p.s.i./ft.). If you have gas supply pressure of 2,000 p.s.i., it will lift the gas on the downstream side by 4301 feet. If the pipeline depth is greater than 4301 feet, the pipeline is effectively completely blocked. Accumulated salt water in the 11,000 foot deep pipeline would be able to block a pressure of 5,115 p.s.i. (0.465*11,000).

BRIEF SUMMARY OF THE INVENTION

The object of this invention is to provide a method of removing unwanted liquids from a subsea pipeline by displacing the unwanted fluids with a lower density fluid which can be more easily removed by pumping.

A second object of this invention is to provide a method of removing unwanted liquids from a subsea pipeline by displacing the unwanted fluids with a more desirable fluid which can be more easily removed by evaporation.

DETAILED DESCRIPTION OF THE INVENTION

Figure 1:
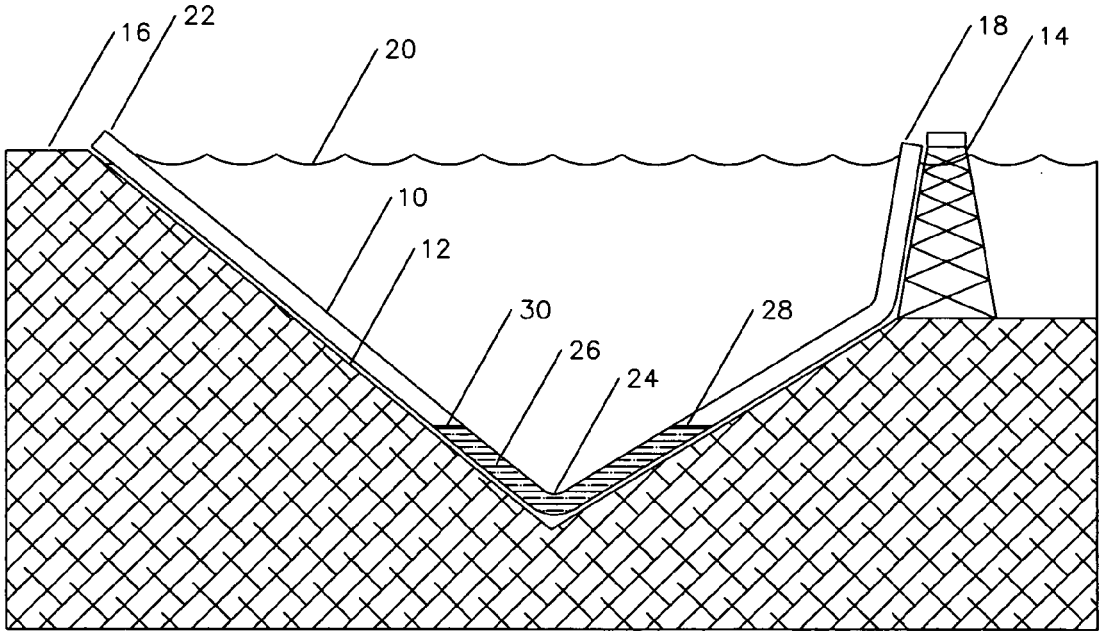
FIG. 1 is a section of a pipeline extending from an offshore platform through a subsea valley and back up to the shore, having water at the low point in the pipeline.

Referring now to FIG. 1, a pipeline 10 is shown on the seafloor 12 between offshore platform 14 and the shore 16. Upstream end 18 of pipeline 10 is approximately at sea level 20 as is the downstream end at 22. The lowest point or "valley" in the pipeline 24 can be as deep as 11,000 feet deep. Water 26 is shown in the pipeline and is presently shown with its upstream end 28 at approximately at the same level as downstream end 30.

Figure 2:
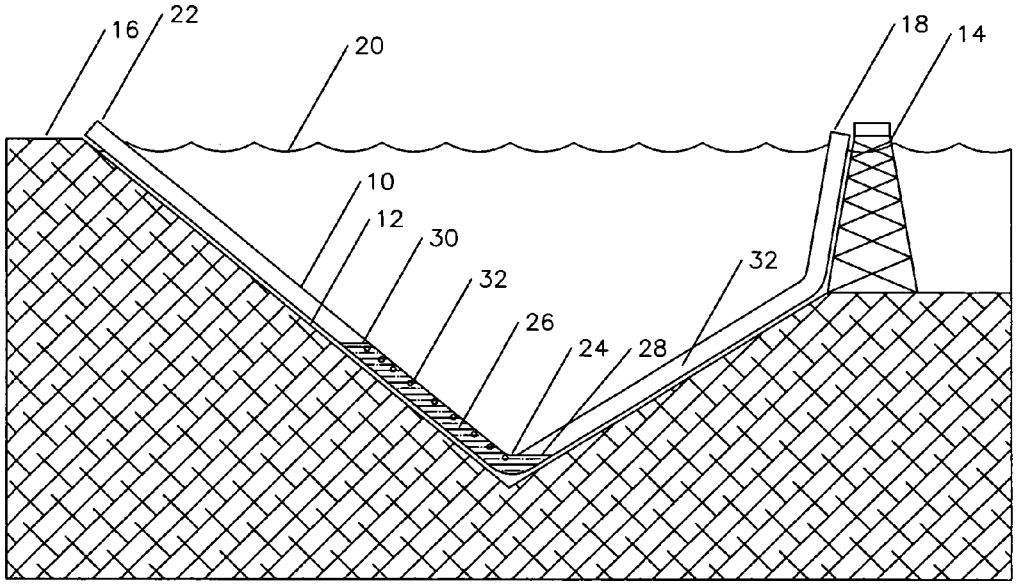
FIG. 2 is a section of the pipeline of FIG. 1 showing the water displaced towards the downstream side of the low point by gas pressure from the upstream side and gas percolating through the water.

Referring now to FIG. 2, the upstream gas pressure 32 has been increased to force the water at the upstream end 28 down to the level of the upper side of the low point of the pipeline at 24. The water at the downstream end 30 is pushed up enough that gas bubbles 32 are percolating through the water 26. The differing head pressure of the water is the gas pressure differential required to accomplish this. Again, this head pressure is generally calculated by the difference in height times 0.465 p.s.i. per foot. Additional flows of gas in the pipeline will not remove the water, but simply pass through the water until enough water accumulates such that it will no longer flow at all.

Figure 3:
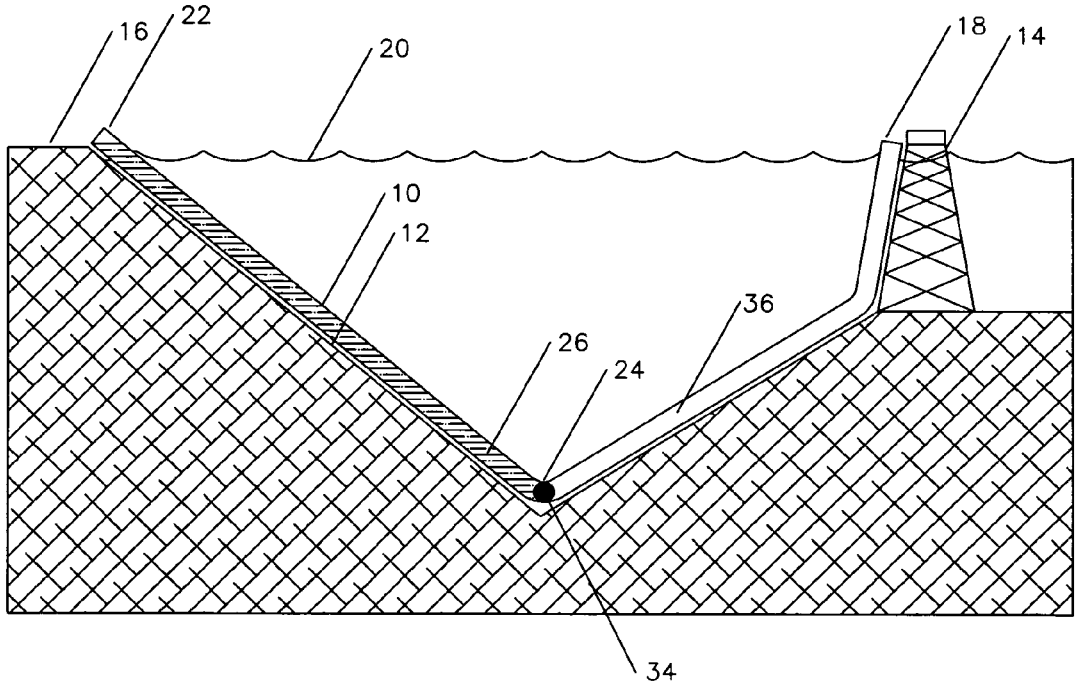
FIG. 3 is a section of the pipeline of FIGS. 1 and 2 showing water being displaced using gas and a pig.

Referring now to FIG. 3, a pipeline pig 34 which seals against the bore of the pipeline has been pushed to the "valley" 24 by a working media 36. As discussed above it would take approximately 5,115 p.s.i. gas to accomplish this if air is the working media.

The compression of gas to these pressures at high volumes associated with large diameter and long subsea pipelines is time consuming and expensive. Finding very large compressors in remote areas operating at that range of pressure would be problematic. The internal volume of a 32 inch diameter pipe 200 miles long is about 4.5 million cu. ft. which would represent an average standard air volume of about 750 million cu. ft. As air has substantial oxygen in it, it has more than a chance of auto-igniting or "dieseling" and generating high and damaging pressures. Nitrogen can be used in place of air without the danger of explosions, but would be very high in cost and supply in remote areas is unlikely.

Figure 4:
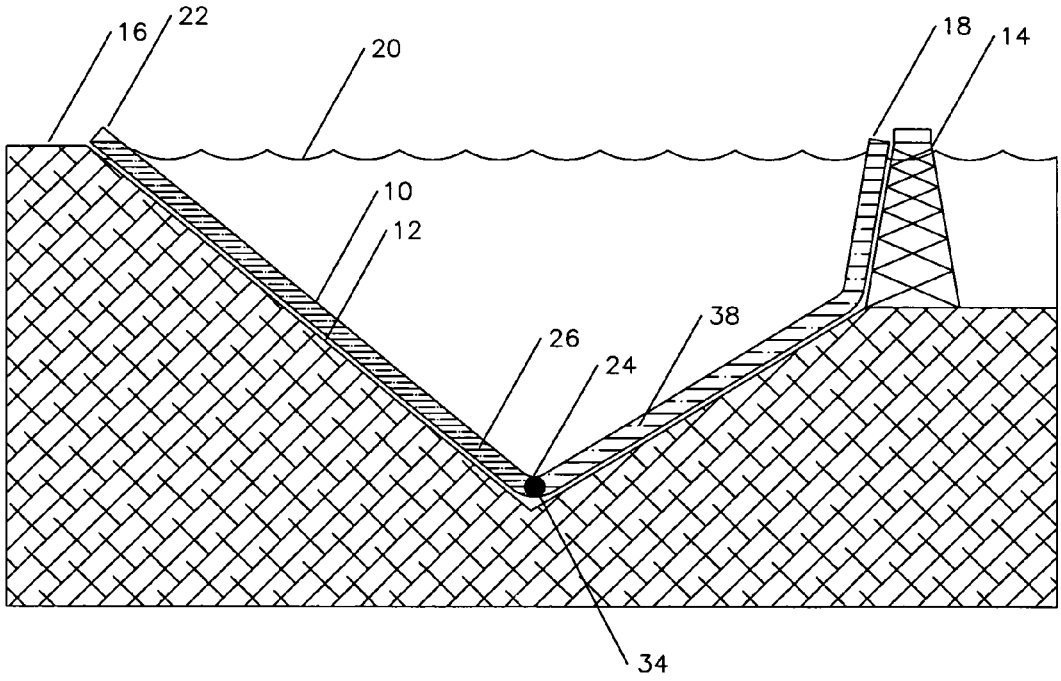
FIG. 4 is a section of the pipeline of FIG. 3 using a low density liquid as the driving means to remove the water from the pipeline.

Referring now to FIG. 4, consider that instead of gas on the upstream side of the pig 34 a different liquid 38 is used. Liquefied propane/butane is a relatively incompressible liquid when subjected to a pressure of at least 28 psi for butane and 112 psi for propane at 68 degrees F. or lower, and is present as a "condensate" in most pipelines. When a liquid at that temperature, the density of butane is 58% that of sea water and that of propane is 50%.

If a 50/50 mixture of propane and butane were to be used as the media for pushing the dewatering pig, more than 50% of the head pressure necessary would be provided by the weight of the liquid mixture in the pipeline. An additional pressure of only 2,400 psi would be required. Further, to pump a liquid instead of a gas it is inherently a much more efficient operation. This means that instead of 5,115 p.s.i. of difficult gas compression, only 2400 p.s.i. of relatively easy liquid pumping would be required.

After the pipeline pig passes the valley and continues up the opposite side, the required pumping pressure would go from a maximum of 2400 p.s.i. to 0 p.s.i. when the mixture reached sea level at the outlet end. At that point as the pipeline if full of mixture, there are two methods of removing the mixture from the pipeline. As it is approximately ½ as heavy as the water was, adequate gas pressure may be available to simply pump it out using a second pig. Secondly, if the downstream end of the pipeline is simply vented at low pressure, the propane/butane mixture will simply evaporate, although it may take a while.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

That which is claimed is:

1. The method of removing a first liquid from a subsea gas pipeline which has an intermediate portion which is lower than the ends of said subsea pipeline, comprising:

displacing said first liquid from said subsea pipeline by pumping a second liquid into said pipeline, and allowing at least a portion of said second liquid to evaporate to a gas.

2. The method of claim 1 further comprising said first liquid is water.

3. The method of claim 1 further comprising said second liquid is propane.

4. The method of claim 1 further comprising said second liquid is butane.

5. The method of claim 1 further comprising said second liquid is a propane/butane mixture.

6. The method of claim 1, further comprising separating said first liquid from said second liquid during said pumping operations with a pig which seals in the bore of said subsea gas pipeline.

* * * * *